US011338422B2

(12) United States Patent
Yamamoto et al.

(10) Patent No.: US 11,338,422 B2
(45) Date of Patent: May 24, 2022

(54) DRIVING TOOL

(71) Applicant: MAX CO., LTD., Tokyo (JP)

(72) Inventors: Yu Yamamoto, Tokyo (JP); Takashi Yuki, Tokyo (JP); Mitsuhiro Kimura, Tokyo (JP); Yasunori Takahashi, Tokyo (JP); Shuhei Kurita, Tokyo (JP)

(73) Assignee: MAX CO., LTD., Tokyo (JP)

( * ) Notice: Subject to any disclaimer, the term of this patent is extended or adjusted under 35 U.S.C. 154(b) by 99 days.

(21) Appl. No.: 16/251,259

(22) Filed: Jan. 18, 2019

(65) Prior Publication Data

US 2019/0224830 A1 Jul. 25, 2019

(30) Foreign Application Priority Data

| | | |
|---|---|---|
| Jan. 19, 2018 | (JP) | JP2018-007520 |
| Jan. 19, 2018 | (JP) | JP2018-007521 |
| Jan. 19, 2018 | (JP) | JP2018-007633 |
| Feb. 9, 2018 | (JP) | JP2018-022480 |
| Feb. 9, 2018 | (JP) | JP2018-022481 |

(51) Int. Cl.
*B25C 1/08* (2006.01)
*F02B 63/02* (2006.01)
(Continued)

(52) U.S. Cl.
CPC ..... *B25C 1/08* (2013.01); *B25C 1/008* (2013.01); *B25D 9/10* (2013.01); *F02B 63/02* (2013.01); *F01L 9/10* (2021.01)

(58) Field of Classification Search
CPC ..... B25C 1/08; B25C 1/008; F02B 63/02; B25D 9/10; F01L 9/02
(Continued)

(56) References Cited

U.S. PATENT DOCUMENTS 3,381,672 A * 5/1968 Albert ..... B21J 7/26 123/74 R
3,638,534 A * 2/1972 Ramspeck ..... B25C 1/041 91/399
(Continued)

FOREIGN PATENT DOCUMENTS

EP 2 433 753 A1 3/2012
JP 51-58768 5/1976
(Continued)

OTHER PUBLICATIONS

European Search Report issued in Application No. 19152498.2, dated Jul. 11, 2019, 7 pages.
(Continued)

*Primary Examiner* — Robert F Long
(74) *Attorney, Agent, or Firm* — Weihrouch IP

(57) ABSTRACT

A driving tool includes a main body, a trigger, a contact member and a control unit. The main body has a combustion chamber configured to be filled with fuel and compressed air. The trigger is configured to operate an ignition device to combust a mixture of the fuel and the compressed air filled in the combustion chamber. The contact member is brought into contact with a driving target member to enable an operation of the trigger. The control unit is configured to start an injection of the fuel when the contact member is turned on, and to complete an injection of the air after the trigger is turned on.

6 Claims, 11 Drawing Sheets

(51) Int. Cl.
*B25D 9/10* (2006.01)
*B25C 1/00* (2006.01)
*F01L 9/10* (2021.01)

(58) Field of Classification Search
USPC ..... 173/1–2, 8, 20, 201, 46–49, 216–217
See application file for complete search history.

(56) References Cited

U.S. PATENT DOCUMENTS 3,850,359 A * 11/1974 Obergfell ..... B25C 1/08 227/10
4,075,850 A 2/1978 Nakazato et al.
4,483,474 A * 11/1984 Nikolich ..... B25C 1/008 123/46 SC
4,593,846 A * 6/1986 Evertz ..... B25C 1/047 227/130
4,739,915 A 4/1988 Cotta
5,363,999 A 11/1994 Braun et al.
5,370,295 A 12/1994 Simonelli
6,237,827 B1 5/2001 Reckelhoff
6,378,288 B1 4/2002 Towfighi et al.
6,722,550 B1 * 4/2004 Ricordi ..... B25C 1/08 123/46 SC
8,091,751 B2 1/2012 Tanaka
8,215,529 B2 * 7/2012 Wu ..... B25C 1/04 227/130
8,479,963 B2 * 7/2013 Kitagawa ..... B25C 1/008 227/8
2004/0026476 A1 2/2004 Shima et al.
2004/0079302 A1 * 4/2004 Wolf ..... B25C 1/08 123/46 R
2004/0134961 A1 * 7/2004 Wolf ..... B25C 1/08 227/10
2004/0182336 A1 9/2004 Ohmori et al.
2004/0232191 A1 * 11/2004 Schiestl ..... B25C 1/08 227/10
2005/0001004 A1 * 1/2005 Fujisawa ..... B25C 1/08 227/10
2005/0001007 A1 * 1/2005 Butzen ..... B25C 1/047 227/130
2005/0029323 A1 2/2005 Shima et al.
2005/0098123 A1 * 5/2005 Miyata ..... B25C 1/08 123/46 SC
2005/0120983 A1 * 6/2005 Adams ..... F02B 71/00 123/46 R
2006/0065691 A1 3/2006 Shima et al.
2006/0237513 A1 * 10/2006 Tanaka ..... B25C 1/08 227/10
2006/0283909 A1 12/2006 Shima et al.
2007/0210132 A1 9/2007 Akiba
2008/0210734 A1 * 9/2008 Uejima ..... B25C 1/08 227/2
2008/0223895 A1 * 9/2008 Fujisawa ..... B25C 1/08 227/2
2008/0251558 A1 10/2008 Suda
2008/0251559 A1 * 10/2008 Uejima ..... B25C 1/003 227/3
2008/0314952 A1 * 12/2008 Tamura ..... B25C 1/08 227/10
2009/0188962 A1 * 7/2009 Sauer ..... B25C 1/08 227/10
2009/0250499 A1 10/2009 Hahn et al.
2010/0032467 A1 * 2/2010 Tanaka ..... B25C 1/08 227/8
2010/0108736 A1 * 5/2010 Tanaka ..... B25C 1/08 227/10
2010/0176177 A1 7/2010 Tanaka
2010/0230461 A1 9/2010 Tanaka
2010/0327039 A1 * 12/2010 Adams ..... B25C 1/08 227/9
2011/0073336 A1 3/2011 Baba et al.
2012/0153003 A1 6/2012 Dittrich
2012/0211539 A1 8/2012 Kosuge et al.
2013/0270319 A1 * 10/2013 Gauger ..... B25C 1/08 227/2
2014/0069981 A1 * 3/2014 Ricordi ..... B25C 1/08 227/8
2014/0360744 A1 * 12/2014 Lawrence ..... B25B 23/1453 173/109
2016/0144496 A1 * 5/2016 Raggl ..... B25C 1/08 29/432
2016/0144497 A1 * 5/2016 Boehm ..... B25C 1/143 227/2
2016/0303724 A1 10/2016 Dittrich et al.
2017/0209995 A1 * 7/2017 Iijima ..... B25C 1/043
2019/0224831 A1 * 7/2019 Yamamoto ..... B25D 9/10

FOREIGN PATENT DOCUMENTS

JP S53-004384 U 1/1978
JP 63-28574 A 2/1988
JP H07-164349 A 6/1995
JP 2000-158361 A 6/2000
JP 2001-260049 A 9/2001
JP 2004-314263 A 11/2001
JP 2004-074296 A 3/2004
JP 2004-333120 A 11/2004
JP 2006-000956 A 1/2006
JP 2007-237328 A 9/2007
JP 2008-036800 A 2/2008
JP 2008-260100 A 10/2008
JP 2009-045676 A 5/2009
JP 2009-248302 A 10/2009
JP 2011-073110 A 4/2011
JP 2012-125919 A 7/2012
JP 2012-171055 A 9/2012
JP 2016-538146 A 12/2016
WO 2007-048006 A2 4/2007
WO 2009-051195 A1 4/2009

OTHER PUBLICATIONS

The Japanese Office Action for application No. 2018-007633 dated Aug. 24, 2021 (5 pages, non-English).
The Japanese Office Action for application No. 2018-007521 dated Aug. 24, 2021 (4 pages, non-English).
The Japanese Office Action for application No. 2018-022480 dated Aug. 17, 2021 (3 pages, non-English).
The Japanese Office Action for application No. 2018-022481 dated Aug. 17, 2021 (4 pages, non-English).
Japanese Office Action for corresponding JP Application No. 2018-007520 dated Aug. 3, 2021. (4 pp).

* cited by examiner (CONT.)

(FIG. 4 CONTINUED)
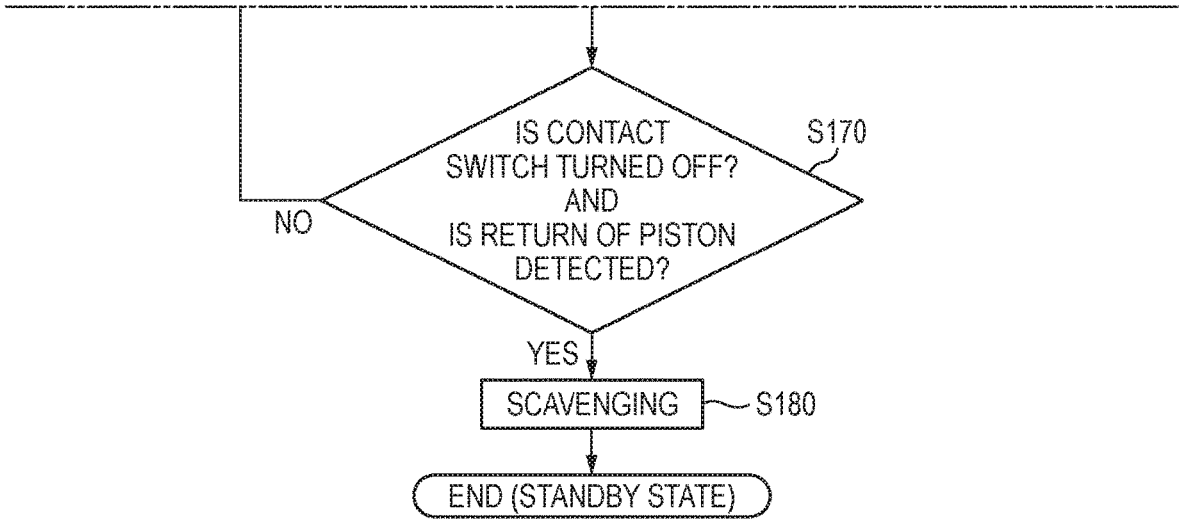

DRIVING TOOL

CROSS-REFERENCE TO RELATED APPLICATIONS

This application is based on and claims priority under 35 USC 119 from Japanese Patent Application Nos. 2018-022480 filed on Feb. 9, 2018, 2018-007520 filed on Jan. 19, 2018, 2018-007521 filed on Jan. 19, 2018, 2018-007633 filed on Jan. 19, 2018, and 2018-022481 filed on Feb. 9, 2018, the contents of which are incorporated herein by reference.

TECHNICAL FIELD

The invention relates to a driving tool.

BACKGROUND ART

In the related art, a driving tool which uses a mixture of fuel and air comes into wide use. This kind of driving tool is configured such that after the mixture of the fuel and the air is generated in a combustion chamber, the mixture is ignited and combusted to generate high combustion pressure and drive a piston in a cylinder, and a nail supplied to a nose is struck by a driver integrally formed in the piston to be driven out.

For example, in JP-A-S51-58768, an internal combustion type impact tool is disclosed in which after a combustible gas flows in an explosion chamber by pulling up a trigger, a compressed air is supplied to the explosion chamber by pulling up the trigger further, so as to generate a mixture gas of the combustible gas and the compressed air in the explosion chamber. In addition, in JP-A-S63-28574, an internal-combustion type fastener driving tool is disclosed in which a plurality of cams are rotated in accordance with an operation of a manual trigger so that an airframe fuel is introduced into the combustion chamber, and then a gaseous oxidant is introduced into the combustion chamber to form the mixture of the oxidant and the fuel.

SUMMARY OF INVENTION

Problems to be Solved by Invention

However, in the conventional driving tool which uses the fuel and the air described in JP-A-S51-58768 or the like, a driving operation is performed by a sequence in which the fuel is injected into the combustion chamber after a trigger operation, then the air is injected to generate the mixture, and the mixture is ignited. For this reason, there is a problem such that, after the trigger is operated by the operator, the nail cannot be immediately driven in a driving target member. That is, there is a problem such that the operation response (trigger response) from the trigger operation to the nail driving is poor.

In this regard, the invention is made in consideration of the above problems, and an object thereof is to provide a driving tool which is capable of immediately performing a driving operation after a trigger operation by an operator in a driving tool which uses fuel and compressed air.

Means for Solving Problems

A driving tool includes a main body, a trigger, a contact member and a control unit. The main body has a combustion chamber configured to be filled with fuel and compressed air. The trigger is configured to operate an ignition device to combust a mixture of the fuel and the compressed air filled in the combustion chamber. The contact member is brought into contact with a driving target member to enable an operation of the trigger. The control unit is configured to start an injection of the fuel when the contact member is turned on, and to complete an injection of the air after the trigger is turned on.

Effects of Invention

According to the invention, the injection of the fuel is started when the contact member is turned on, and the injection of the air is completed after the trigger is turned on. Thus, it is possible to shorten a time from the trigger operation to the nail driving. Accordingly, it is possible to improve the operation response after the trigger operation.

DESCRIPTION OF EMBODIMENTS

Hereinafter, preferred embodiments of the invention will be described in detail with reference to the accompanying drawings. Incidentally, dimensions ratios of drawings are extended for explanation and may differ from actual ratios.

First Embodiment

[Configuration Example of Driving Tool 10]

Figure 1:
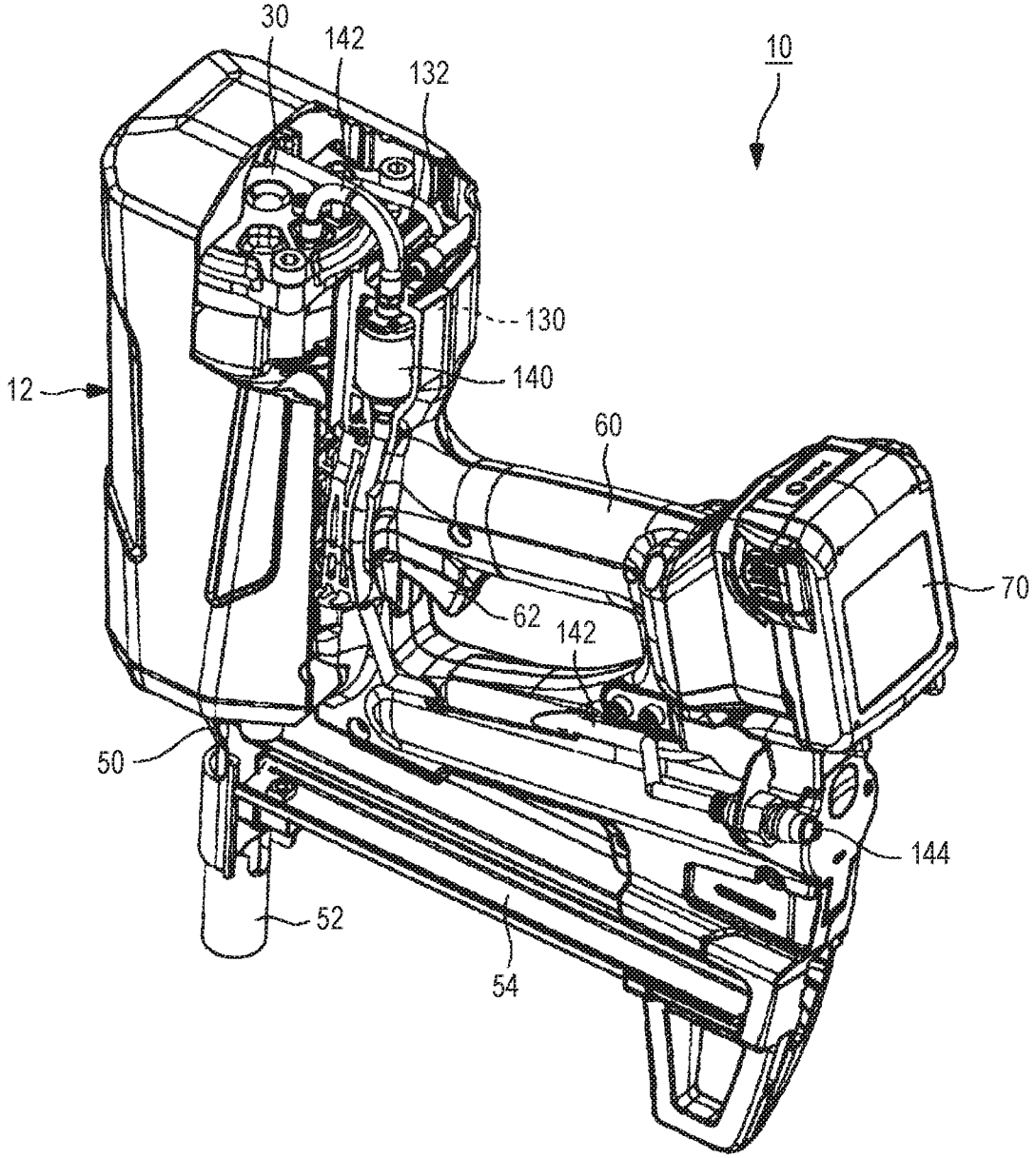
FIG. 1 is a perspective view of a driving tool according to one embodiment of the invention.
Figure 2:
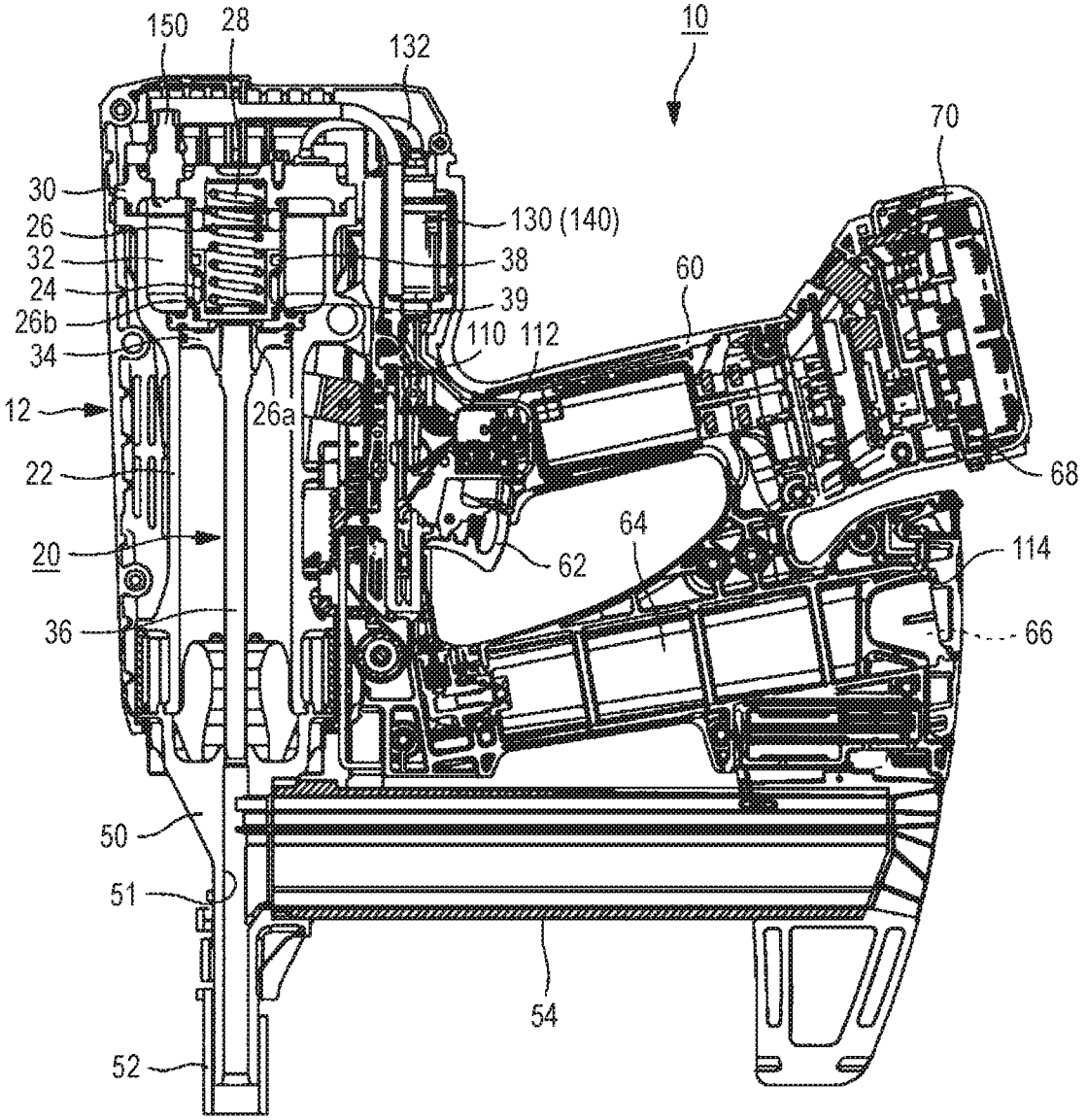
FIG. 2 is a sectional view of the driving tool.

FIGS. 1 and 2 illustrate one example of a configuration of the driving tool 10 according to one embodiment of the invention. In FIGS. 1 and 2, a nail driving direction is set to a lower side, and the opposite side thereof is set to an upper side. In FIGS. 1 and 2, a tool body 12 is set to a front side, a the battery 70 is set to a rear side, a contact arm 52 is set to a lower side, and a cylinder head 30 is set to an upper side. In the direction orthogonal to the longitudinal direction and the vertical direction of the driving tool 10, when the front direction is set as a reference, the right side is set to the right side of the driving tool 10, and the left side is set to the left side of the driving tool 10.

As illustrated in FIGS. 1 and 2, the driving tool 10 is a tool which drives a fastener such as a nail, a staple, and a pin into a driving target member such as wood, gypsum board, steel plate, and concrete. The driving tool includes the tool body 12, a nose 50, the contact arm 52, a grip 60, a trigger 62, a battery mounting part 68, a gas cartridge storage part 64, and a magazine 54.

The tool body 12 is configured in a slender and approximately cylindrical shape, and a driving mechanism 20 for driving operation is stored in the tool body 12.

The driving mechanism 20 has a cylinder 22, a head valve 24, a sleeve 26, a spring 28, the cylinder head 30, a piston 34, and a driver 36.

The cylinder 22 is configured to have a cylindrical shape having a diameter smaller than that of the tool body 12 and is disposed inside the tool body 12. A combustion chamber 32 which is configured to be filled with the fuel and the compressed air is provided on the upper side in the cylinder 22. The combustion chamber 32 is a space which is sectioned into the inner circumferential surface of the cylinder 22, the outer circumferential surface of the sleeve 26, and the lower surface portion of the sleeve 26.

The piston 34 is disposed at an initial position which is inside the cylinder 22 and below the sleeve 26. The piston is capable of sliding the cylinder 22 in the vertical direction in accordance with the combustion pressure generated when the mixture of the fuel and the compressed air filled in the combustion chamber 32 is ignited. Herein, the initial position of the piston 34 is a position where the piston 34 comes into contact with the lower surface of the sleeve 26 in the cylinder 22 and is a stop position before the piston 34 moves downward in the cylinder 22 by the combustion pressure generated when the mixture in the combustion chamber 32 is ignited. The driver 36 is integrally formed in the lower end portion of the piston 34. The driver moves in the nose 50 in accordance with the movement of the piston 34 to drive the nail supplied from the magazine 54 into the driving target member.

The sleeve 26 is configured in a cylindrical body and is arranged in the combustion chamber 32. A first opening part 26*a* communicating with the upper space of the piston 34 is provided in the bottom surface portion of the sleeve 26. A second opening part 26*b* communicating the combustion chamber 32 with the first opening part 26*a* is provided in the lower end portion of the cylindrical part of the sleeve 26.

The head valve 24 is configured to be a cylindrical body in which the upper end portion is opened, and the lower end portion is closed and is arranged inside the sleeve 26 and above the piston 34. Seal members 38 and 39 for sealing a gap from the sleeve 26 are provided in the upper portion and the lower portion of the outer circumferential portion of the head valve 24, respectively. The seal member 38 projects than the seal member 39 in a radial direction. The head valve 24 is configured to be vertically movable in the sleeve 26 by the combustion pressure generated during the combustion of the mixture in the combustion chamber 32, so that the combustion pressure can flow from the inside of the combustion chamber 32 into the cylinder 22 disposed with the piston 34 through the first opening part 26*a* and the second opening part 26*b*.

The spring 28 is configured by a compression spring and is disposed coaxially with the driver 36 inside the head valve 24. In the spring 28, the upper end portion thereof abuts on the cylinder head 30, and the lower end portion thereof abuts on the bottom surface portion of the head valve 24, so as to bias the head valve 24 to the lower side.

The cylinder head 30 is attached in the upper end portion of the cylinder 22, so as to close the upper end opening of the combustion chamber 32. The cylinder head 30 is provided with a fuel injection port (not illustrated) for injecting fuel into the combustion chamber 32 and an air injection port (not illustrated) for injecting compressed air into the combustion chamber 32.

A fuel injection valve 130 opens and closes a flow passage of a fuel hose 132 and controls the amount of the fuel supplied into the combustion chamber 32. The fuel injection valve 130 is installed in the middle of the fuel hose 132 and is disposed on the upper rear side of the cylinder 22. One end portion of the fuel hose 132 is connected with the fuel injection port of the cylinder head 30, and the other end portion of the fuel hose 132 is connected with the gas cartridge storage part 64.

An air injection valve 140 opens and closes a flow passage of an air hose 142 and controls the amount of the compressed air supplied into the combustion chamber 32. The air injection valve 140 is installed in the middle of the air hose 142 and is disposed on the upper rear side of the cylinder 22 and on the left side of the fuel injection valve 130 in FIG. 1 in parallel. The air injection valve 140 is disposed in parallel with the fuel injection valve 130, so as to reduce the size of the entire driving tool 10. In addition, a disturbance does not occur when the grip 60 is held. In addition, the fuel injection valve 130 and the air injection valve 140 are disposed near the combustion chamber 32 above the cylinder 22. Thus, the response in filling the combustion chamber 32 with the fuel or the compressed air is excellent. One end portion of the air hose 142 is connected with the air injection port of the cylinder head 30, and the other end portion of the air hose 142 is connected with an air plug 144. For example, an air compressor, an air tank for storing compressed air, or the like is connected with the air plug 144 and is configured such that the compressed air can be fed from the outside of the driving tool 10 into the combustion chamber 32.

The nose 50 is formed integrally with the lower end portion of the tool body 12. An injection port 51 which extends in the vertical direction and communicates with the cylinder 22 is provided at the center of the nose 50. The injection port 51 guides the driver 36 (piston 34) along the vertical direction.

The contact arm 52 is attached in the outer circumferential portion f the tip of the nose 50 and is configured to be movable to the relatively upper side with respect to the nose 50 when pressed against the driving target member. The operation of the trigger 62 becomes active when the contact arm 52 moves to a predetermined position by the pressing operation.

The grip 60 is formed to have an approximately cylindrical shape which is easy for the operator to grasp, and extends toward the rear side from the approximately central side surface portion of the tool body 12 in the vertical direction (longitudinal direction). The battery mounting part 68 is provided in the rear end portion of the grip 60. The battery 70 is detachably attached in the battery mounting part 68. For example, a battery with a built-in secondary battery such as a lithium battery with a voltage of 14.4 V can be used as the battery 70.

The trigger 62 is a part for the operator to operate the driving operation of the nail and is provided on the front lower surface side of the grip 60 to project toward the magazine 54.

The gas cartridge storage part 64 is arranged between the grip 60 and the magazine 54 and extends from the side surface portion of the tool body 12 in substantially parallel with the grip 60. A fuel container is detachably attached in the gas cartridge storage part 64.

The magazine 54 is attached on the rear portion side of the nose 50 and is configured such that a plurality of nails can be loaded. The magazine 54 communicates with the injection port 51 of the nose 50 and is configured such that the nail can be supplied to the nose 50.

[Block Diagram of Driving Tool 10]

Figure 3:
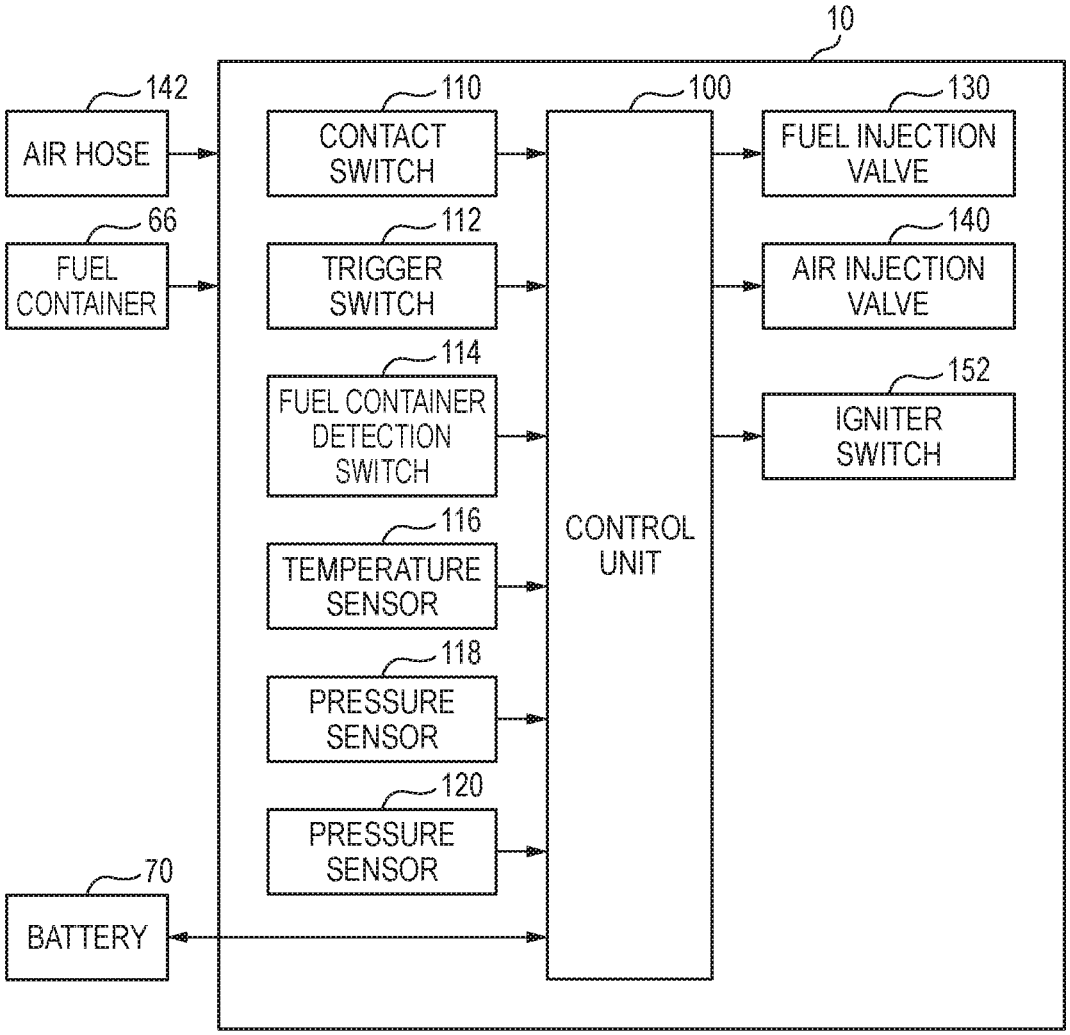
FIG. 3 is a block diagram illustrating one example of a functional configuration of the driving tool.

FIG. 3 is a block diagram illustrating one example of a functional configuration of the driving tool 10 according to the invention. As illustrated in FIG. 3, the driving tool 10 includes a control unit 100 for controlling the operation of the entire tool. The control unit 100 has a CPU, a ROM, and a RAM. The CPU develops a program stored in the ROM into the RAM and executes the program to realize a predetermined driving operation including the control of the injection timings of the fuel and the compressed air. More specifically, the control unit 100 executes control to start the injection of the fuel when a contact switch 110 is turned on by pressing the contact arm 52 against the driving target member and to complete the injection of the compressed air after a trigger switch 112 is turned on by the operation of the trigger 62.

The control unit 100 is connected with the contact switch 110, the trigger switch 112, a fuel container detection switch 114, a temperature sensor 116, the pressure sensors 118 and 120, the fuel injection valve 130, the air injection valve 140, an ignition plug 150, and the battery 70 which supplies power to the control unit 100 or the like. Incidentally, in the case of the configuration in which the temperature sensor 116 and the pressure sensors 118 and 120 are not used, the driving tool 10 can be configured without the temperature sensor and the pressure sensor.

The contact switch 110 is connected with the contact arm 52 through a link member. The contact switch 110 is turned on when the contact arm 52 moves to a predetermined position toward the nose 50 by being pressed against the driving target member and outputs an "on" signal indicating that the contact arm 52 is turned on to the control unit 100.

The trigger switch 112 is provided near the trigger 62. The trigger switch 112 is turned on in accordance with the pulling operation of the trigger 62 by the operator and outputs an "on" signal indicating that the trigger 62 is turned on to the control unit 100.

The fuel container detection switch 114 is provided on the inlet side of the gas cartridge storage part 64. The fuel container detection switch is turned on when the fuel container is mounted on the gas cartridge storage part 64 and outputs an "on" signal indicating that the fuel container is mounted to the control unit 100.

For example, the temperature sensor 116 is installed in the combustion chamber 32 or near the combustion chamber 32. The temperature sensor 116 detects a machine temperature in the tool body 12 or an environmental temperature near the driving tool 10 and outputs the temperature information to the control unit 100.

For example, the pressure sensor 118 is installed in the air hose 142 which extends between the air plug 144 and the air injection valve 140. The pressure sensor 118 detects whether or not an air source such as a compressor is connected with the air plug 144 or detects whether or not an abnormality occurs in the air pressure supplied from the air source such as the compressor, and supplies the pressure information to the control unit 100.

For example, the pressure sensor 120 is installed in the air hose 142 which extends in the combustion chamber 32 or between the combustion chamber 32 and the air injection valve 140. The pressure sensor 120 detects the abnormality of the air filling pressure in the combustion chamber 32 and supplies the detected pressure information to the control unit 100. A check valve (not illustrated) may be provided between the combustion chamber 32 and the pressure sensor 120.

The fuel injection valve 130 is operated (opened/closed) based on a driving signal supplied from the control unit 100, and the file filled in a metering chamber in the valve is supplied into the combustion chamber 32.

The air injection valve 140 is operated (opened/closed) based on a driving signal supplied from the control unit 100 and a predetermined amount of compressed air is injected into the combustion chamber 32.

An igniter switch 152 of an igniter unit is turned on based on a control signal supplied from the control unit 100, and the mixture filled in the combustion chamber 32 is combusted by igniting the ignition plug 150.

[Operational Example of Driving Tool 10]

Figure 4:
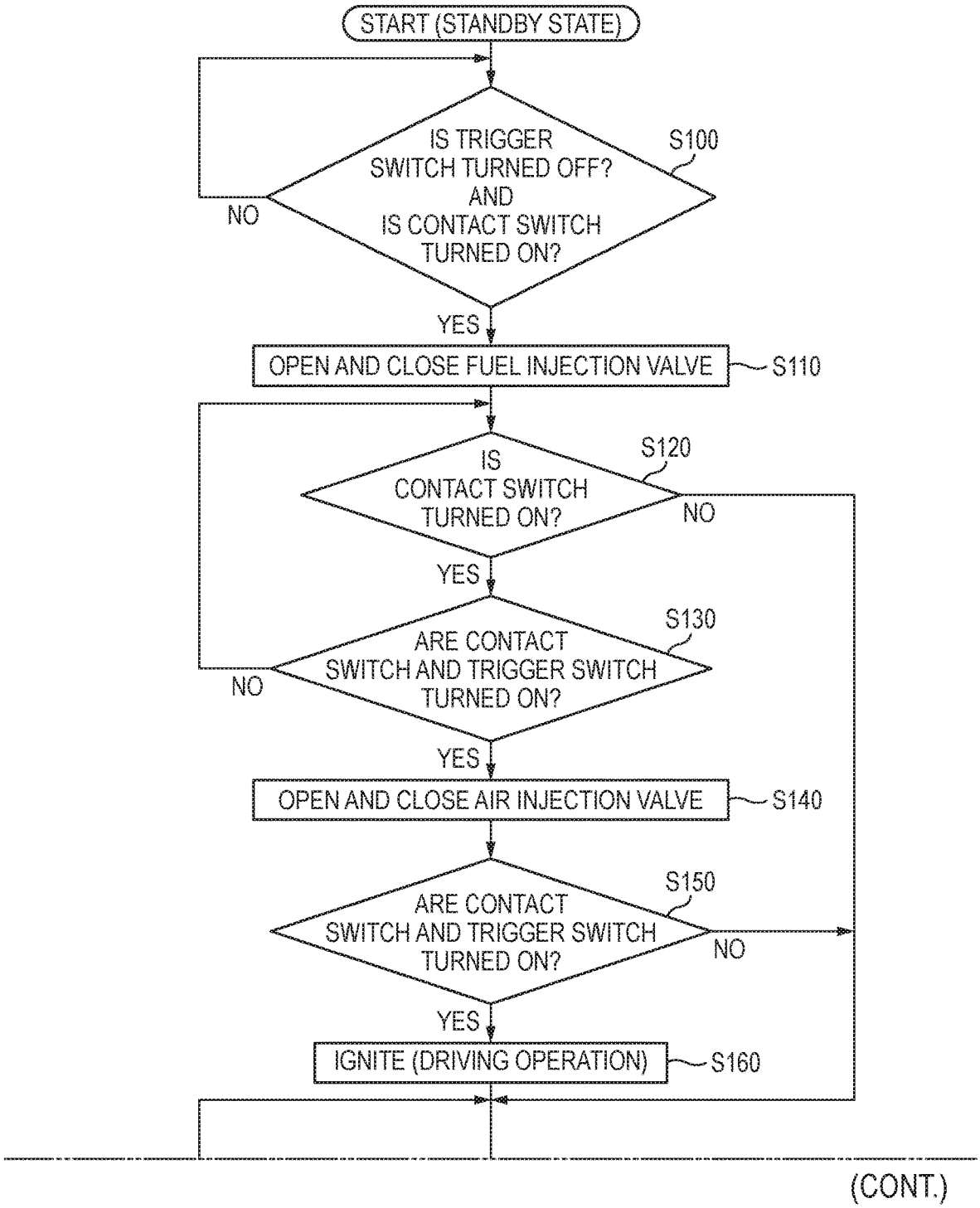
FIG. 4 is a flowchart illustrating a driving operation of the driving tool.

FIG. 4 is a flowchart illustrating one example of the operation of the control unit 100 when the driving tool 10 according to the invention is driven.

As illustrated in FIG. 4, in step S100, the control unit 100 determines whether or not the trigger switch 112 is turned off and the contact switch 110 is turned on by pressing the contact arm 52 against the driving target member. The control unit 100 continuously monitors the state of the contact switch 110 or the like in a case where the contact switch 110 and the trigger switch 112 are turned off. On the other hand, when the control unit 100 determines that the trigger switch 112 is turned off, and the contact switch 110 is turned on, the procedure proceeds to step S110.

In step S110, the control unit 100 outputs an "on" signal to the fuel injection valve 130, and operates the fuel injection valve 130 to be opened and the fuel injection valve 130 to be closed after a predetermined time elapses. Accordingly, a predetermined amount of fuel is injected into the combustion chamber 32. When step S110 is ended, the procedure proceeds to step S120.

In step S120, the control unit 100 determines whether the contact switch 110 is not turned off by separating the contact arm 52 from the driving target member, that is, whether or not the contact switch 110 is turned on. In a case where the contact switch 110 is continuously turned on, the control unit 100 proceeds to step S130. On the other hand, in a case where the contact switch 110 is turned off, the control unit 100 proceeds to step S170.

In step S130, the control unit 100 determines whether or not both of the contact switch 110 and the trigger switch 112 are turned on. In a case where it is determined that at least one of the contact switch 110 and the trigger switch 112 is turned off, the control unit 100 returns to step S120. On the other hand, in a case where it is determined that both of the contact switch 110 and the trigger switch 112 are turned on, the control unit 100 proceeds to step S140.

In step S140, the control unit 100 outputs an "on" signal to the air injection valve 140, and operates the air injection valve 140 to be opened and the air injection valve 140 to be closed after a predetermined time elapses. Accordingly, a predetermined amount of compressed air is injected into the combustion chamber 32, and the inside of the combustion chamber 32 is stirred by the injection of the compressed air, so as to generate the mixture of the fuel and the compressed air. In this embodiment, the fuel and the compressed air are injected in this order into the combustion chamber 32. Thus, the fuel and the compressed air are uniformly mixed in the combustion chamber 32. Accordingly, the mixing ratio in the combustion chamber 32 is not deviated, and thus it is possible to prevent occurrence of abnormal combustion. When step S140 is ended, the procedure proceeds to step S150.

In step S150, the control unit 100 determines whether or not both of the contact switch 110 and the trigger switch 112 are turned on before the ignition of the mixture. In a case where it is determined that both of the contact switch 110 and the trigger switch 112 are not turned on, the control unit 100 proceeds to step S170. In step S180, as described above, the control unit 100 executes scavenging for discharging the fuel or the mixture remaining in the combustion chamber 32 to the outside.

On the other hand, in a case where it is determined that both of the contact switch 110 and the trigger switch 112 are turned on, the control unit 100 proceeds to step S160.

In step S160, the control unit 100 activates the igniter switch 152 to spark the ignition plug 150, thereby combusting the mixture filled in the combustion chamber 32. Accordingly, the head valve 24 is opened, and the piston 34 reciprocates in the cylinder 22 by the combustion pressure flowing in from the combustion chamber 32, thereby performing the driving operation. After step S160 is ended, the procedure proceeds to step S170.

In step S170, the control unit 100 determines whether or not the return of the piston 34 is detected when the contact switch 110 is turned off, the return of the piston 34 is detected when the contact switch 110 and the trigger switch 112 are turned off, or the return is detected when the trigger switch 112 is turned off. For example, the return of the piston 34 is determined depending on whether a predetermined time elapses since the trigger 62 is turned on, or whether a predetermined time elapses since the spark signal is output to the igniter switch 152. The control unit 100 performs monitoring until any one of the conditions is satisfied.

On the other hand, in a case where it is determined that the contact switch 110 is turned off, and the piston 34 returns to the initial position, the control unit 100 proceeds to step S180. In step S180, the control unit 100 executes scavenging for discharging the fuel (mixture) remaining in the combustion chamber 32 or the exhaust gas after combustion from the inside of the combustion chamber 32 to the outside. In this embodiment, such processings are executed repeatedly. Incidentally, when step S180 is not executed immediately after the condition of step S170 is satisfied, and step S180 (scavenging) is executed after the predetermined time elapses, the fuel or the exhaust gas remaining in the combustion chamber 32 can be discharged to a certain extent before the start of scavenging, so as to prevent the consumption amount of the air used in the scavenging.

[Timing Chart During Operation of Driving Tool 10]

Figure 5:
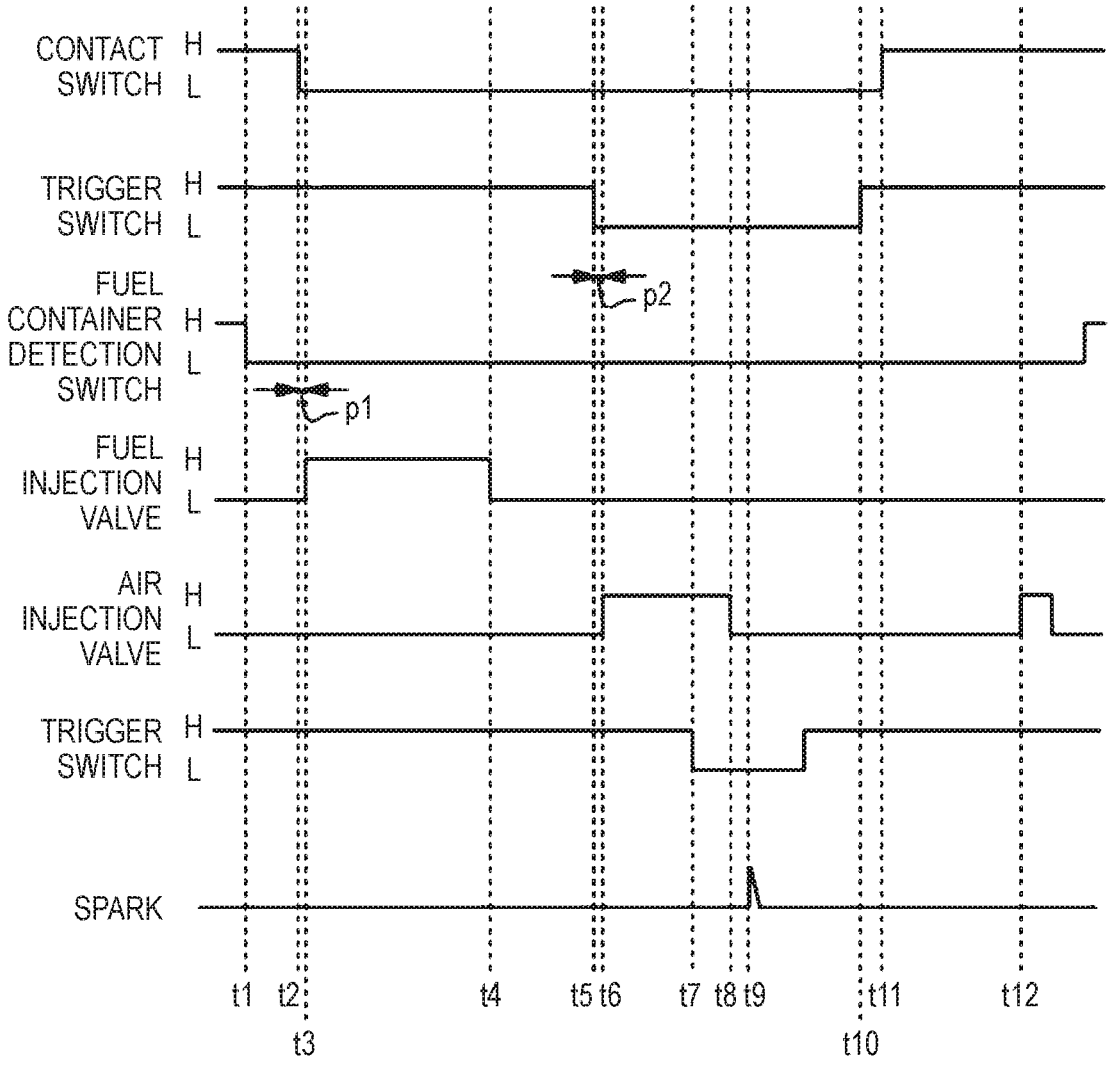
FIG. 5 is a first timing chart of each device during the driving operation of the driving tool.

FIG. 5 illustrates one example of a timing chart in each device during the driving operation of the driving tool 10 according to the invention.

As illustrated in FIG. 5, at time t1, when the fuel container 66 is mounted in the gas cartridge storage part 64 by the operator, the fuel container detection switch 114 is switched from a high level to a low level, and the fuel container detection switch 114 is turned on.

At time t2, when the contact arm 52 is pressed against the driving target member by the operator, the contact arm 52 moves relatively upward with respect to the nose 50, and when the contact switch 110 is switched from a high level to a low level, the contact switch 110 is turned on.

When the contact arm 52 is continuously turned on for period p1, at time t3, the driving signal output to the fuel injection valve 130 is switched from a low level to a high level. Accordingly, the fuel injection valve 130 is opened, and the fuel is injected from the fuel injection port of the cylinder head 30 into the combustion chamber 32 for the injection time obtained by calculation in advance.

At time t4, the driving signal supplied to the fuel injection valve 130 is switched from the high level to the low level. Accordingly, the fuel injection valve 130 is closed, and the injection of the fuel from the fuel injection port of the cylinder head 30 into the combustion chamber 32 is stopped.

At time t5, when the trigger 62 is pulled by the operator in a state where the contact arm 52 is turned on, the trigger switch 112 is switched from a high level to a low level, and the trigger switch 112 is turned on.

When both of the contact switch 110 and the trigger switch 112 are continuously turned on for period p2, at time t6, the driving signal supplied to the air injection valve 140 is switched from a low level to a high level. Accordingly, the air injection valve 140 is opened, and the compressed air is injected from the air injection port of the cylinder head 30 into the combustion chamber 32 for the injection time corresponding to the set output energy, incidentally, the output energy can be selected to be any level of low, medium, and high by the switch provided near the battery mounting part 68.

At time t7, the driving signal supplied to the igniter switch 152 is switched from a high level to a low level, and the boosting of the voltage to the ignition plug 150 is started. At time t9, the boosting of the ignition plug 150 to the discharge voltage is completed, and the mixture in the combustion chamber 32 is ignited. The timing of the ignition is set in consideration of the time of boosting the ignition plug 150 to the discharge voltage and is set such that the driving operation is started by igniting the mixture in the combustion chamber 32 immediately after the completion of the injection of the compressed air.

At time t8, when the air injection time set in advance elapses, the driving signal supplied to the air injection valve 140 is switched from a high level to a low level. Accordingly, the air injection valve 140 is closed, and the injection of the compressed air from the air injection port of the cylinder head 30 into the combustion chamber 32 is stopped.

At time t9, the mixture in the combustion chamber 32 is ignited. Accordingly, the mixture in the combustion chamber 32 combusts immediately after the completion of the injection of the compressed air, and the head valve 24 is opened by the combustion pressure generated during the combustion. The combustion pressure flows in the cylinder 22, and the piston 34 moves downward in the cylinder 22 so as to perform the driving operation.

At time t10, when the nail driving to the driving target member is completed, and the finger of the operator is separated from the trigger 62, the trigger switch 112 is switched from the low level to the high level, and the trigger switch 112 is turned off.

At time t11, when the contact arm 52 is separated from the driving target member to return to the initial position (the position where the tip projects from the nose 50), the contact switch 110 is switched from the low level to the high level, and the contact switch 110 is turned off.

At time t12 after the contact switch 110 is turned off, the driving signal supplied to the air injection valve 140 is switched from the low level to the high level. Accordingly, the air injection valve 140 is opened, and the compressed air is injected from the air injection port of the cylinder head 30 into the combustion chamber 32 for the injection time set in advance, whereby the scavenging for discharging the exhaust gas in the combustion chamber 32 is executed. The scavenging is preferably performed in a state where the piston 34 completely returns to stop at the initial position, so as not to affect the returning operation of the piston 34. There is risk that the scavenging of injecting the compressed air hinders the returning operation of the piston 34. However, if the return of the piston 34 is completed reliably, the return of the piston 34 is not affected. In addition, after the return of the piston 34 is completed, the volume of exhaust gas to be scavenged is reduced. For this reason, it is possible to reduce the time required for the scavenging or the amount of the compressed air to be injected. Further, when the volume to be scavenged is small, the possibility of remaining the exhaust gas also can be lowered, and thus the effect of the exhaust gas on the next driving operation can be reduced.

Incidentally, the scavenging may be executed at any time other than the above-described timing. For example, in a case where the temperature in the combustion chamber 32 measured by the temperature sensor 116 exceeds the reference temperature set in advance, the air injection valve 140 may be controlled to be opened/closed to inject the compressed air into the combustion chamber 32, so as to execute a cooling mode of automatically cooling the inside of the combustion chamber 32 or the periphery thereof. The reference temperature can be a preset numerical value or can be an arbitrary numerical value set by an operator. In addition, an operation unit for selecting the cooling mode may be provided in the driving tool 10, and the operator may execute the cooling mode manually. That is, the operator may operate the operation unit at an arbitrary timing, so as to inject the compressed air into the combustion chamber 32.

As described above, according to the first embodiment, after the fuel is injected by the operation of the contact arm 52, the compressed air is injected by the operation of the trigger 62. Thus, the time from turning-on of the trigger 62 to the nail driving can be shortened, and the trigger response in the driving tool 10 can be improved compared to a case where both of the fuel and the compressed air are injected in this order by the operation of the trigger 62.

When the start of the injection of the compressed air is interlocked with the operation of the trigger 62, the contact can be made again for positioning without consuming the air. Thus, it is possible to prevent the wasteful consumption of the air and to increase a work amount. In addition, the compressed air is not injected when the contact arm 52 is turned on, and the compressed air is completely injected after the trigger 62 is turned on. Thus, the compressed air required for combusting is not supplied into the combustion chamber 32 only by the operation of the contact arm 52. Thus, it is possible to prevent the combustion pressure of a specified value or more is generated in the combustion chamber 32 even when the concentration of the fuel (gas) becomes high. Accordingly, the driving force can be stabilized by the stabilization of the combustion pressure, and the durability of the driving tool 10 can be secured.

According to this embodiment, the fuel is injected into the combustion chamber 32 when the contact switch 110 is turned on, and then the compressed air is injected into the combustion chamber 32 when the trigger switch 112 is turned on. Thus, the fuel in the combustion chamber 32 can be stirred by the compressed air injected into the combustion chamber 32. Accordingly, the fuel and the compressed air are mixed uniformly, and thus the combustion efficiency during the sparking of the driving operation can be improved.

Since the ignition timing of the ignition plug 150 is set in consideration of the discharge voltage of the ignition plug 150, that is, the time when the voltage boosts, the ignition of the fuel can be performed at an optimum timing (immediately after the injection of the compressed air is completed). As a result, it is possible to improve the fuel efficiency and the trigger response.

Even in a case where the injection time of the compressed air is adjusted because of the variation of the output energy or the like, the ignition of the fuel can be performed at the optimum timing immediately after the injection of the compressed air is completed, and the combustion efficiency and the trigger response can be improved.

First Modification of First Embodiment

Figure 6:
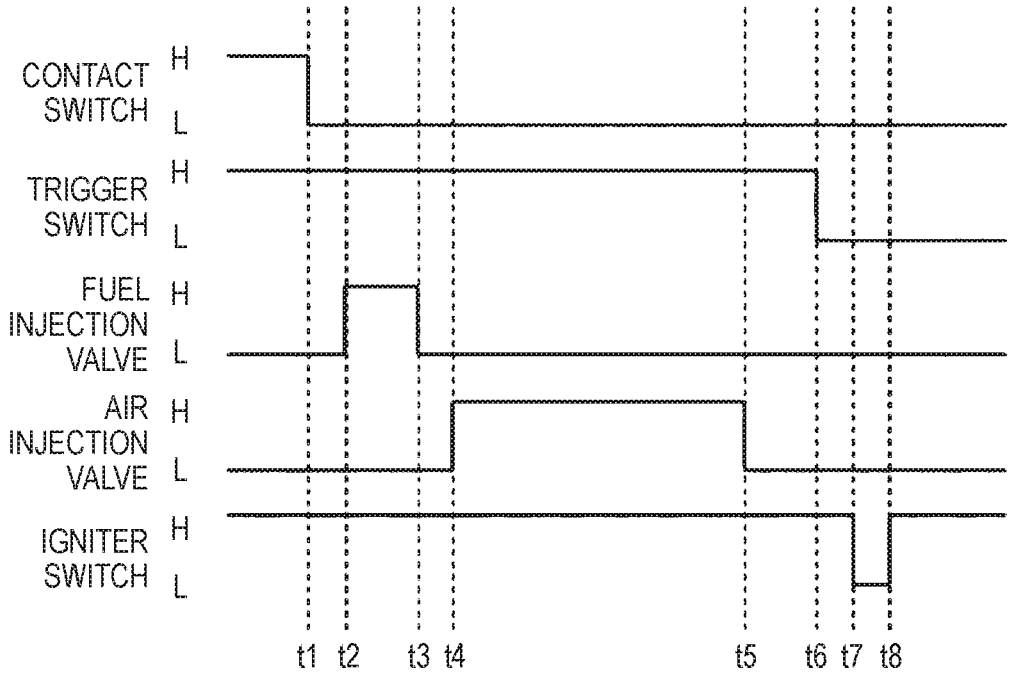
FIG. 6 is a second timing chart of each device during the driving operation of the driving tool.

Next, the description will be given about one example of the control in which both of the injection of the fuel and the injection of the compressed air are performed after the contact switch 110 is turned on. FIG. 6 illustrates one example of a second timing chart during the driving operation of the driving tool 10 according to the invention.

As illustrated in FIG. 6, at time t1, when the contact arm 52 is pressed against the driving target member by the operator, the contact arm 52 moves relatively upward with respect to the nose 50, and when the contact switch 110 is switched from the high level to the low level, the contact switch 110 is turned on.

When the contact arm 52 is continuously turned on for a predetermined time, at time t2, the driving signal output to the fuel injection valve 130 is switched from the low level to the high level. Accordingly, the fuel injection valve 130 is opened, and the fuel is injected from the fuel injection port of the cylinder head 30 into the combustion chamber 32 for the injection time obtained by calculation in advance.

At time t3, the driving signal supplied to the fuel injection valve 130 is switched from the high level to the low level. Accordingly, the fuel injection valve 130 is closed, and the injection of the fuel from the fuel injection port of the cylinder head 30 into the combustion chamber 32 is stopped.

At time t4, the driving signal supplied to the air injection valve 140 is switched from the low level to the high level. Accordingly, the air injection valve 140 is opened, and the compressed air is injected from the air injection port of the cylinder head 30 into the combustion chamber 32 for the injection time corresponding to the set output energy.

At time t5, when the air injection time set in advance elapses, the driving signal supplied to the air injection valve 140 is switched from the high level to the low level. Accordingly, the air injection valve 140 is closed, and the injection of the compressed air from the air injection port of the cylinder head 30 into the combustion chamber 32 is stopped.

At time t6, when the trigger 62 is pulled by the operator in a state where the contact arm 52 is turned on, the trigger switch 112 is switched from the high level to the low level, and the trigger switch 112 is turned on.

During times t7 to t8, the driving signal supplied to the igniter switch 152 is switched from the high level to the low level, and the ignition plug 150 is ignited. Accordingly, the driving operation is performed.

In this way, in the first modification of the first embodiment, both of the injection of the fuel and the injection of the compressed air are controlled with the turning-on of the contact switch 110 as a trigger. Also in such control, the driving operation can be performed immediately after the compressed air is injected after the trigger 62 is turned on. Thus, the time from the turning-on of the trigger 62 to the nail driving can be shortened, and the operability of the driving tool 10 can be improved.

Second Modification of First Embodiment

Figure 7:
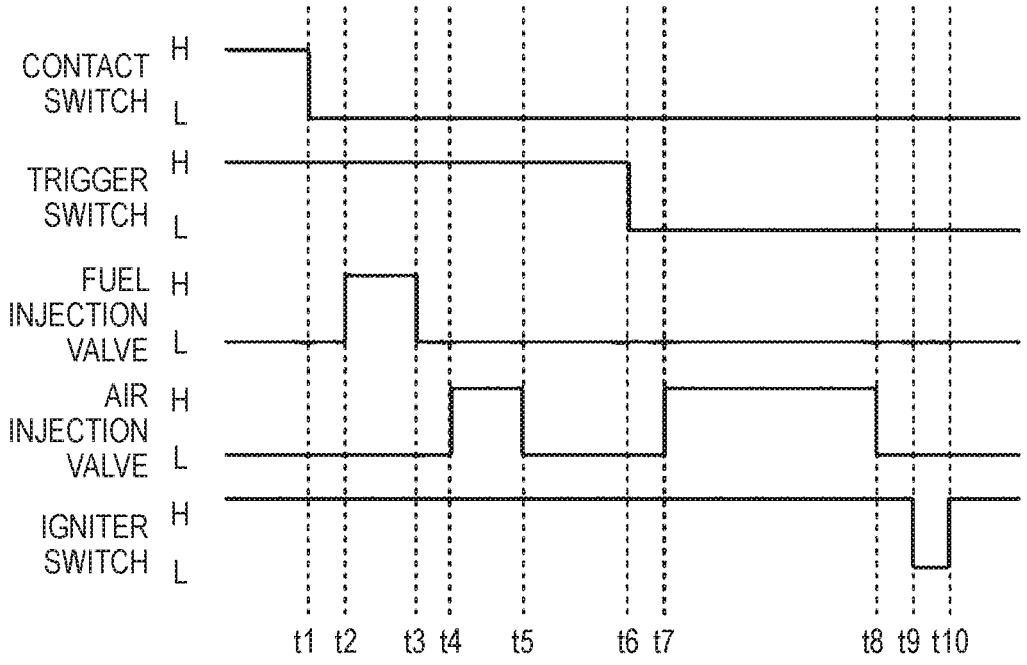
FIG. 7 is a third timing chart of each device during the driving operation of the driving tool.

Next, the description will be given about one example of the control in which the injection of the compressed air is divided into two processes to be performed. FIG. 7 illustrates one example of the timing chart of each device during the driving operation of the driving tool 10 according to the invention.

As illustrated in FIG. 7, at time t1, when the contact arm 52 is pressed against the driving target member by the operator, the contact arm 52 moves relatively upward with respect to the nose 50, and when the contact switch 110 is switched from the high level to the low level, the contact switch 110 is turned on.

When the contact arm 52 is continuously turned on for a predetermined time, at time t2, the driving signal output to the fuel injection valve 130 is switched from the low level to the high level. Accordingly, the fuel injection valve 130 is opened, and the fuel is injected from the fuel injection port of the cylinder head 30 into the combustion chamber 32 for the injection time obtained by calculation in advance.

At time t3, the driving signal supplied to the fuel injection valve 130 is switched from the high level to the low level. Accordingly, the fuel injection valve 130 is closed, and the injection of the fuel from the fuel injection port of the cylinder head 30 into the combustion chamber 32 is stopped.

At time t4, the driving signal supplied to the air injection valve 140 is switched from the low level to the high level. Accordingly, the air injection valve 140 is opened, and a first injection of the compressed air is performed from the air injection port of the cylinder head 30 into the combustion chamber 32. For example, in the first injection of the compressed air, the injection is performed during one-fourth of the total injection time.

At time t5, when the air injection time set in advance elapses, the driving signal supplied to the air injection valve 140 is switched from the high level to the low level. Accordingly, the air injection valve 140 is closed, and the injection of the compressed air from the air injection port of the cylinder head 30 into the combustion chamber 32 is stopped.

At time t6, when the trigger 62 is pulled by the operator in a state where the contact arm 52 is turned on, the trigger switch 112 is switched from the high level to the low level, and the trigger switch 112 is turned on.

At time t7, the driving signal supplied to the air injection valve 140 is switched from the low level to the high level. Accordingly, the air injection valve 140 is opened, and a second injection of the compressed air is performed from the air injection port of the cylinder head 30 into the combustion chamber 32. For example, in the second injection of the compressed air, the injection is performed during the remaining three-fourths of the total injection time.

At time t8, when the air injection time set in advance elapses, the driving signal supplied to the air injection valve 140 is switched from the high level to the low level. Accordingly, the air injection valve 140 is closed, and the injection of the compressed air from the air injection port of the cylinder head 30 into the combustion chamber 32 is stopped.

During times t9 to t10, the driving signal supplied to the igniter switch 152 is switched from the high level to the low level, and the ignition plug 150 is turned on. Accordingly, the driving operation is performed.

In this way, in a second modification of the first embodiment, the first injection of the compressed air is controlled to be performed when the contact switch 110 is turned on, and the second injection of the compressed air is controlled to be performed when the trigger switch 112 is turned on. Also in such control, the driving operation can be performed immediately after the compressed air is injected after the trigger 62 is turned on. Thus, the time from the turning-on of the trigger 62 to the nail driving can be shortened, and the operability of the driving tool 10 can be improved.

Second Embodiment

In a second embodiment, the scavenging of the driving tool 10 will be described in detail. Incidentally, the basic configuration and operation of the driving tool 10 are similar to those of the first embodiment. Thus, the same reference numeral is attached to the common component, and the detailed description is omitted.

[Timing Chart During Operation of Driving Tool 10]

Figure 8:
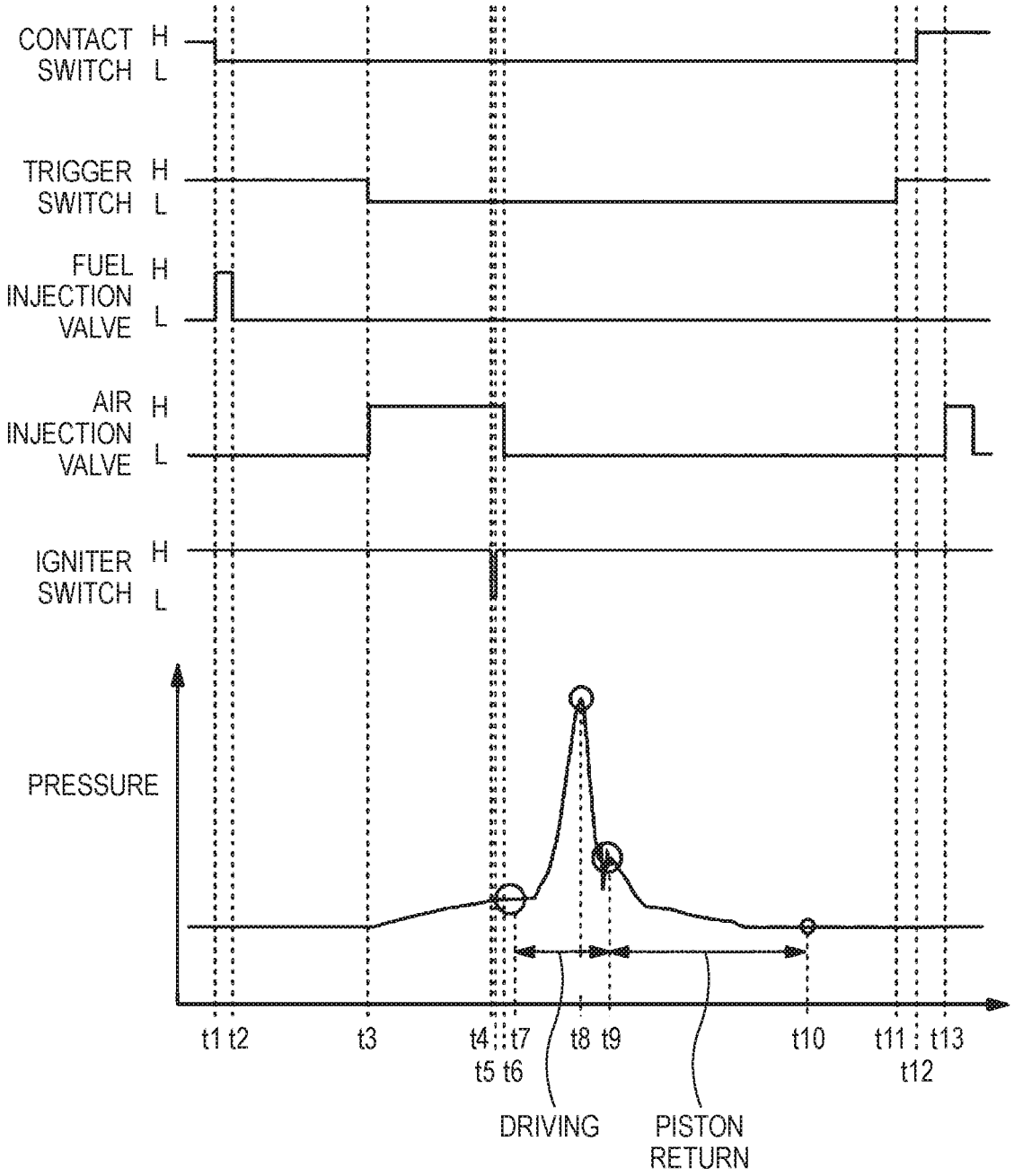
FIG. 8 is a timing chart for explaining a scavenging operation in a driving tool according to a second embodiment of the invention.

FIG. 8 illustrates a timing chart of each device during the driving operation of the driving tool 10 according to the invention and a graph of a fluctuation of the pressure in the combustion chamber 32. Incidentally, in the graph, the vertical axis is pressure, and the horizontal axis is time.

As illustrated in FIG. 8, at time t1, when the contact arm 52 is pressed against the driving target member by the operator, the contact arm 52 moves relatively upward with respect to the nose 50, and when the contact switch 110 is switched from the high level to the low level, the contact switch 110 is turned on.

When the contact switch 110 is turned on, the driving signal output to the fuel injection valve 130 is switched from the low level to the high level. Accordingly, the fuel injection valve 130 is opened, and the fuel is injected from the fuel injection port of the cylinder head 30 into the combustion chamber 32. At time t2, the driving signal supplied to the fuel injection valve 130 is switched from the high level to the low level. Accordingly, the fuel injection valve 130 is closed, and the injection of the fuel from the fuel injection port of the cylinder head 30 into the combustion chamber 32 is stopped.

At time t3, when the trigger 62 is pulled by the operator in a state where the contact arm 52 is turned on, the trigger switch 112 is switched from the high level to the low level, and the trigger switch 112 is turned on.

When both of the contact switch 110 and the trigger switch 112 are turned on, the driving signal supplied to the air injection valve 140 is switched from the low level to the high level. Accordingly, the air injection valve 140 is opened, and the compressed air is injected from the air injection port of the cylinder head 30 into the combustion chamber 32.

During times t4 to t5, the igniter switch 152 is switched from the high level to the low level, and the igniter switch 152 is turned on. Accordingly, the boosting of the voltage to the ignition plug 150 is started.

At time t6, when the air injection time set in advance elapses, the driving signal supplied to the air injection valve 140 is switched from the high level to the low level. Accordingly, the air injection valve 140 is closed, and the injection of the compressed air from the air injection port of the cylinder head 30 into the combustion chamber 32 is stopped.

In the pressure in the combustion chamber 32, as illustrated in the graph of FIG. 8, when the compressed air is injected into the combustion chamber 32, the pressure in the combustion chamber 32 gradually increases in accordance with the injection amount of the compressed air.

When the igniter switch 152 is turned on at time t4, at time t7, the boosting of the ignition plug to the discharge voltage is completed, and the mixture in the combustion chamber 32 is ignited. Accordingly, the pressure is rapidly increased by the combustion of the mixture in the combustion chamber 32. At time t8 indicating the peak value of the combustion pressure, the head valve 24 is opened, and the piston 34 moves downward in the cylinder 22 by the combustion pressure. The discharging of the combustion gas in the combustion chamber 32 or in the cylinder 22 (above the piston 34) is started in accordance with the movement of the piston 34.

After time t8, the combustion pressure flows in the cylinder 22 so as to rapidly decrease the pressure in the combustion chamber 32.

The piston 34 lands near time t9 so that the driving operation is performed on the driving target member. At this time, an impact is generated in the driving tool 10, and the pressure in the combustion chamber 32 is vibrated vertically in accordance therewith.

At time t10, the piston 34 moves upward in the cylinder 22 to return to the initial position. That is, the return of the piston 34 to the initial position is completed. After driving, the combustion gas in the combustion chamber 32 or in the cylinder 22 is exhausted.

In this embodiment, the control unit 100 determines that the return of the piston 34 is completed when the predetermined time elapses after the trigger 62 is turned on. This is because the injection time of the compressed air, the movement time of the piston 34, or the like can be obtained by calculation in advance. In addition, in another method of detecting the return of the piston 34, it may be determined depending on whether the predetermined time elapses after the control unit 100 outputs the spark signal to the igniter switch 152 or determined depending on whether the predetermined time elapses after the detection of the characteristic sound generated during the driving operation, an acceleration, and a distortion. In addition, a position detection unit for detecting the completion of the return of the piston 34 to the initial position is configured by the magnet attached in the piston 34 and the hall sensor attached in the cylinder 22 or the like, for example. The completion (the completion of the driving operation) of the return of the piston 34 may be determined by detecting the output change of the hall sensor by the control unit 100. In addition, the change of the pressure or the like in the combustion chamber 32 can be detected by using the pressure sensor or the like as the position detection unit installed in the combustion chamber 32. The completion of the return of the piston 34 can be determined based on the change of the pressure in the combustion chamber 32. In addition, the completion of the return of the piston 34 can be determined in such a manner that the position of the piston 34 is detected by using magnetism, a laser, or the like as the position detection unit. Further, after the predetermined time elapses after the exhaust from the combustion chamber 32 is started, the control unit 100 may supply the compressed air to the combustion chamber 32 when it is determined that the return of the piston 34 is completed. For example, whether the exhaust gas starts can be determined by the above-described change of the pressure in the combustion chamber 32 or in the cylinder 22 or can be determined by detecting the change of the position of the piston 34.

At time t11, when the nail driving to the driving target member is completed, and the finger of the operator is separated from the trigger 62, the trigger switch 112 is switched from the low level to the high level, and the trigger switch 112 is turned off.

At time t12, when the contact arm 52 is separated from the driving target member to return to the initial position, the contact switch 110 is switched from the low level to the high level, and the contact switch 110 is turned off.

When the contact switch 110 is turned off, at time t13 after the predetermined time elapses, the driving signal supplied to the air injection valve 140 is switched from the low level to the high level. Accordingly, the air injection valve 140 is opened, and the compressed air is injected from the air injection port of the cylinder head 30 into the combustion chamber 32 for the injection time set in advance, whereby the scavenging for discharging the exhaust gas in the combustion chamber 32 is executed. In this way, in this embodiment, in a case where the control unit 100 detects that the contact switch 110 is turned off, and the return of the piston 34 is detected, that is, after the nail driving to the driving target member is completed, the scavenging is executed.

As described above, according to the second embodiment, after the completion of the driving operation, the scavenging is automatically performed on the inside of the combustion chamber 32, and the exhaust gas in the combustion chamber 32 is discharged. Thus, the inside of the combustion chamber 32 can become clean, and the output of the next driving operation can be stabilized. In addition, it is possible to improve the ignitability and workability with respect to the mixture.

It is sufficiently assumed that the driving tool 10 is lifted by the reaction generated by driving the nail and is out of contact before the piston 34 is fully returned. According to this embodiment, the return of the piston 34 is completed, and then the air injection valve 140 is operated to perform the scavenging. Thus, it is possible to prevent the failure of the reliable scavenging and the return of the piston 34. In addition, since the returning operation of the piston 34 is not inhibited, it is possible to realize the more stable driving operation.

In the general driving tool 10, for example, under a low temperature environment, the ignition performance is affected largely. Thus, it is necessary to perform more reliable scavenging in the combustion chamber 32. According to this embodiment, the scavenging can be executed after the completion of the driving operation. Thus, it is possible to reliably prevent the deterioration of the ignition performance. In addition, the scavenging time is configured to be variable, so as to reduce the consumption amount of the air.

In a case where it is determined that the return of the piston 34 is completed after the predetermined time elapses since the trigger 62 is turn on, the displacement detection of the piston 34 or the like is not required, and the structure of the driving tool 10 can be simplified.

In a case where only the contact arm 52 is operated to be turned on, it is possible to discharge the fuel injected into the combustion chamber 32 or scavenge the mixture which remains in the combustion chamber 32 in a case where non-ignition occurs for some reason. Accordingly, the next combustion is performed at the optimum ratio of fuel to air. Thus, the output of the driving operation can be stabilized, or the generation of soot in the fuel hose 132 or the combustion chamber 32 can be prevented.

According to this embodiment, the scavenging can be performed without using a fan and a motor for driving the fan. Thus, the structure of the driving tool 10 can be simplified.

Incidentally, in addition to a case where the return of the piston 34 is detected, the scavenging can be executed when the contact switch 110 is turned off. For example, the control unit 100 may perform scavenging when it can be detected that the contact arm 52 is turned off without the trigger 62 turned on after the contact arm 52 is turned on. Accordingly, it is possible to quickly perform the scavenging. In addition, when the contact arm 52 is turned on again, the fuel is not excessively supplied into the combustion chamber 32. Thus, it is possible to stabilize the combustion.

First Modification of Second Embodiment

Figure 9:
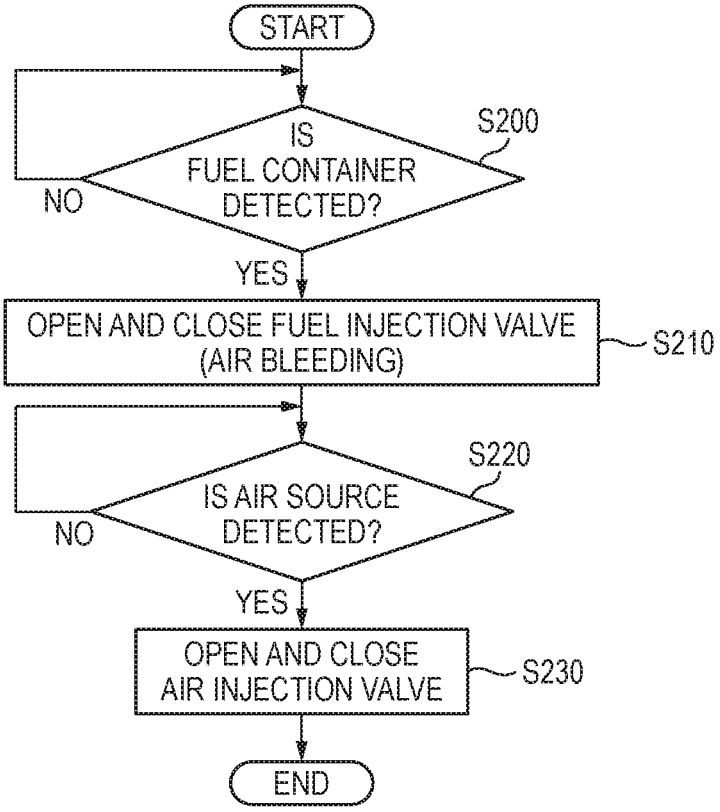
FIG. 9 is a first flowchart illustrating another scavenging operation in the driving tool.

FIG. 9 is a flowchart illustrating one example of the scavenging operation in a case where the fuel container is mounted first, and then air source is mounted next.

As illustrated in FIG. 9, in step S200, the control unit 100 determines based on the output of the fuel container detection switch 114 whether or not the fuel container 66 is mounted in the gas cartridge storage part 64. In a case where it is determined that the fuel container 66 is not mounted in the gas cartridge storage part 64, the control unit 100 continuously monitors whether the fuel container 66 is mounted in the gas cartridge storage part 64. On the other hand, in a case where it is determined that the fuel container 66 is mounted in the gas cartridge storage part 64, the control unit 100 proceeds to step S210.

In step S210, the control unit 100 discharges the air previously accumulated in the fuel hose 132 or in the fuel injection valve 130 into the combustion chamber 32 by controlling the fuel injection valve 130 to be opened/closed. That is, the air bleeding of the fuel injection valve 130 is executed. The control unit 100 stops the operation of the fuel injection valve 130 after the discharge of the air into the fuel hose 132 or the like is completed. After step S210 is completed, the procedure proceeds to step S220.

In step S220, for example, it is determined whether or not the connection of the air source such as the air compressor to the air plug 144 is detected, based on the output of the pressure sensor 118. In a case where it is determined that the connection of the air source to the air plug 144 is not detected, the control unit 100 continuously monitors the connection of the air source to the air plug 144. On the other hand, in a case where it is determined that the connection of the air source to the air plug 144 is detected, the control unit 100 proceeds to step S230.

In step S230, the control unit 100 performs the scavenging in such a manner that a predetermined amount of compressed air is injected into the combustion chamber 32 by controlling the air injection valve 140 to be opened/closed. After the scavenging is performed for the predetermined time, the control unit 100 stops the operation of the air injection valve 140.

According to this modification, the air bleeding is performed when the fuel container 66 is mounted, and the scavenging is performed when the air source is mounted. Thus, the inside of the combustion chamber 32 can be kept in a clean state during the driving. Accordingly, it is possible to stably perform the driving operation and to prevent the generation of soot caused by the thickening of the fuel.

Second Modification of Second Embodiment

Figure 10:
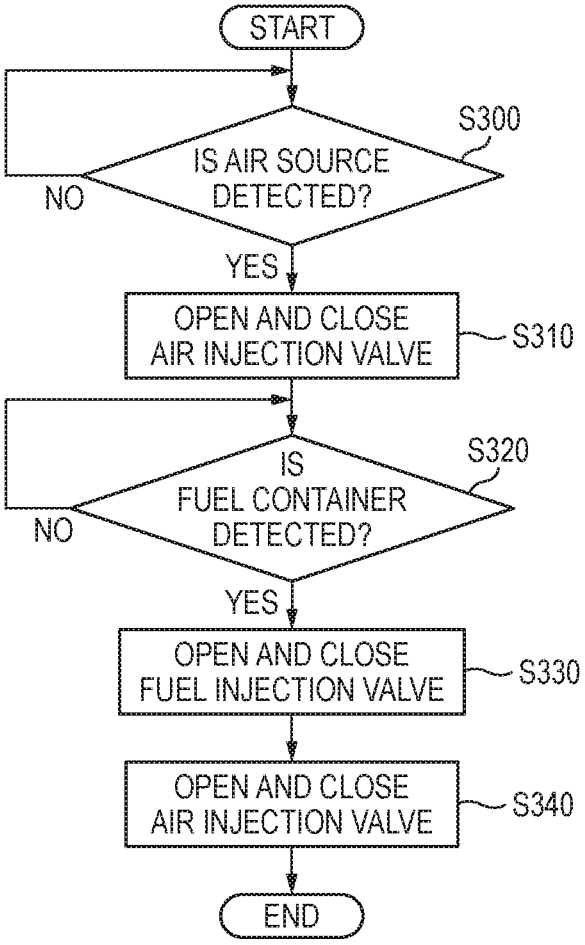
FIG. 10 is a second flowchart illustrating still another scavenging operation in the driving tool.

FIG. 10 is a flowchart illustrating one example of the scavenging operation in a case where the air source is mounted first, and then the fuel container is mounted.

As illustrated in FIG. 10, in step S300, the control unit 100 determines based on the output of the pressure sensor 118 whether or not the air source such as the air compressor is mounted in the air plug 144. In a case where it is determined that the air source is not mounted in the air plug 144, the control unit 100 continuously monitors whether the air source is mounted in the air plug 144. On the other hand, in a case where it is determined that the air source is mounted in the air plug 144, the control unit 100 proceeds to step S310.

In step S310, the control unit 100 performs the scavenging in such a manner that a predetermined amount of compressed air is injected into the combustion chamber 32 by controlling the air injection valve 140 to be opened/closed. After the scavenging is performed for the predetermined time, the control unit 100 stops the operation of the air injection valve 140. After step S310 is completed, the procedure proceeds to step S320.

In step S320, the control unit 100 determines based on the output of the fuel container detection switch 114 whether or not the fuel container 66 is mounted in the gas cartridge storage part 64. In a case where it is determined that the fuel container 66 is not mounted in the gas cartridge storage part 64, the control unit 100 continuously monitors whether the fuel container 66 is mounted in the gas cartridge storage part 64. On the other hand, in a case where it is determined that the fuel container 66 is mounted in the gas cartridge storage part 64, the control unit 100 proceeds to step S330.

In step S330, the control unit 100 performs the air bleeding in such a manner that the air previously accumulated in the fuel hose 132 or in the fuel injection valve 130 is discharged into the combustion chamber 32 by controlling the fuel injection valve 130 to be opened/closed. The control unit 100 stops the operation of the fuel injection valve 130 after the discharge of the air into the fuel hose 132 or the like is completed. After step S330 is completed, the procedure proceeds to step S 340.

In step S340, the control unit 100 performs the scavenging in such a manner that the air injection valve 140 is controlled to be opened/closed to inject a predetermined amount of compressed air into the combustion chamber 32. Accordingly, the fuel accumulated in the combustion chamber 32 is exhausted to the outside. After the scavenging is performed for the predetermined time, the control unit 100 stops the operation of the air injection valve 140.

According to this modification, the air bleeding and the scavenging are performed when the fuel container 66 is mounted after the air source is mounted. Thus, the inside of the combustion chamber 32 can be kept in a clean state during the driving. Accordingly, it is possible to stably perform the driving operation and to prevent the generation of soot caused by the thickening of the fuel.

Third Modification of Second Embodiment

Figure 11:
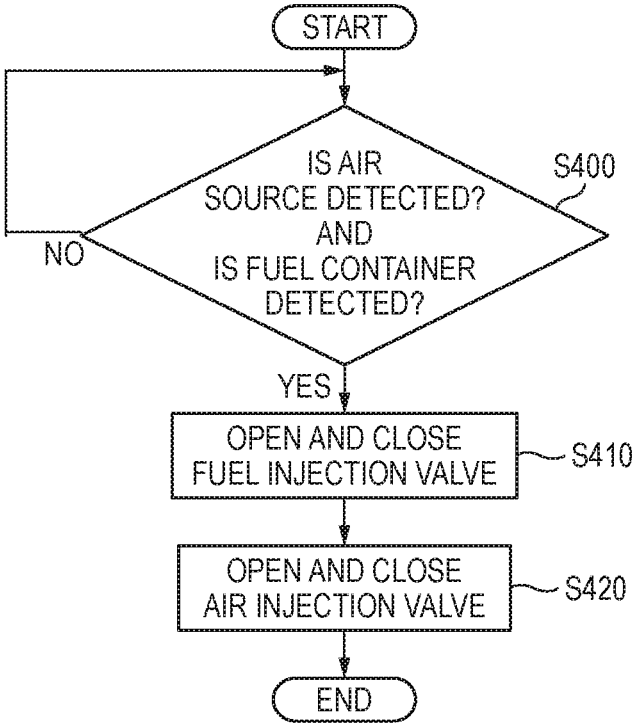
FIG. 11 is a third flowchart illustrating still another scavenging operation in the driving tool.

FIG. 11 is a flowchart illustrating one example of the operation in a case where the scavenging is performed after both of the air source and the fuel container are mounted.

As illustrated in FIG. 11, in step S400, the control unit 100 determines whether or not the air source such as the air compressor is mounted in the air plug 144, and the fuel container 66 is mounted in the gas cartridge storage part 64. In a case where it is determined that the air source is mounted in the air plug 144, and the fuel container 66 is not mounted in the gas cartridge storage part 64, the control unit 100 continuously monitors whether the air source and the fuel container 66 are mounted. On the other hand, in a case where it is determined that the air source is mounted in the air plug 144, and the fuel container 66 is mounted in the gas cartridge storage part 64, the control unit 100 proceeds to step S410.

In step S410, the control unit 100 performs the air bleeding in such a manner that the air previously accumulated in the fuel hose 132 or in the fuel injection valve 130 is discharged into the combustion chamber 32 by controlling the fuel injection valve 130 to be opened/closed. The control unit 100 stops the operation of the fuel injection valve 130 after the discharge of the air into the fuel hose 132 or the like is completed. After step S410 is completed, the procedure proceeds to step S420.

In step S420, the control unit 100 performs the scavenging in such a manner that a predetermined amount of compressed air is injected into the combustion chamber 32 by controlling the air injection valve 140 to be opened/closed. Accordingly, the fuel accumulated in the combustion chamber 32 is exhausted to the outside. After the scavenging is performed for the predetermined time, the control unit 100 stops the operation of the air injection valve 140.

According to this modification, the air bleeding and the scavenging are performed when the air source and the fuel container 66 are mounted. Thus, the inside of the combustion chamber 32 can be kept in a clean state during the driving. Accordingly, it is possible to stably perform the driving operation and to prevent the generation of soot caused by the thickening of the fuel.

Third Embodiment

In the third embodiment, the operation of the machine is controlled based on the state information of the driving tool 10. Incidentally, the basic configuration and operation of the driving tool 10 are similar to those of the first embodiment. Thus, the same reference numeral is attached to the common component, and the detailed description is omitted.

Figure 12:
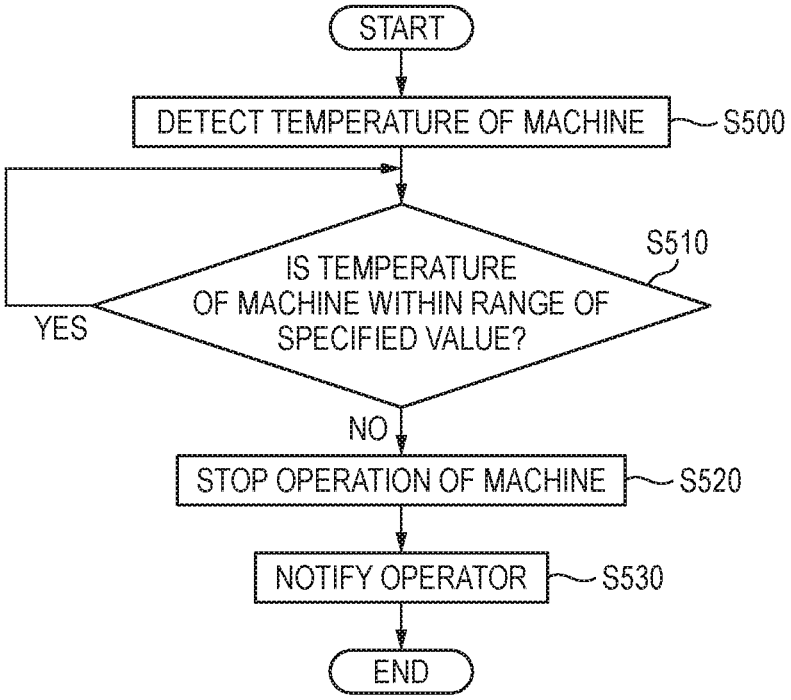
FIG. 12 is a flowchart illustrating an operation of a driving tool according to a third embodiment of the invention during abnormality detection.

FIG. 12 is a flowchart illustrating one example of the operation in a case where the abnormality of the machine in the driving tool 10 is determined. As illustrated in FIG. 12, in step S500, the temperature of the driving mechanism 20 or the like in the tool body 12 is detected (acquired) by the temperature sensor 116. The control unit 100 acquires the temperature information of a machine (mechanism part) such as the driving mechanism 20 in the driving tool 10 from the temperature sensor 116. After step S500 is completed, the procedure proceeds to step S510.

In step S510, the control unit 100 determines whether or not the temperature of the machine of the driving tool 10 is within a range of the specified value set in advance. In a case where the temperature of the machine of the driving tool 10 is within the range of the specified value, the control unit 100 determines that the machine of the driving tool 10 is operated normally and continuously monitors the temperature of the machine of the driving tool 10. On the other hand, in a case where the temperature of the machine of the driving tool 10 is not within the range of the specified value, the control unit 100 determines that the abnormality occurs in the machine of the driving tool 10, and the procedure proceeds to step S520.

In step S520, the control unit 100 stops the operation of the machine of the driving tool 10. Specifically, the control unit 100 performs control not to operate at least one of the fuel injection valve 130, the air injection valve 140, and the ignition plug 150, and stops the driving operation. When step S520 is completed, the procedure proceeds to step S530.

In step S530, the control unit 100 notifies the operator of the occurrence of the abnormality in the machine of the driving tool 10. A light emitting element (light emitting element body) such as an LED lighted in a predetermined color or lighted in a predetermined pattern or a voice output part for performing warning sound and voice guidance can be used as one example of the notification unit. In addition, a plurality of different notification patterns corresponding to the abnormal content can be set for the lighting pattern or the output pattern of the warning sound. Accordingly, the operator can accurately grasp what kind of abnormality occurs in the driving tool 10 by the warning sound or the lighting pattern.

Incidentally, in the above-described example, the description is given about an example in which the temperature information of the driving tool 10 is used as the state information of the driving tool 10. However, the invention is not limited thereto. For example, by using the information of at least one of the pressure value of the compressed air supplied to the driving tool 10, the pressure value in the combustion chamber 32 into which the compressed air is injected, and the voltage value of the battery 70, the control unit 100 can determine the occurrence of the abnormality of the machine based on whether or not such information is within the range of the reference value set in advance. Herein, the pressure value of the compressed air supplied to the driving tool 10 can be detected by the pressure sensor 118, the pressure value in the combustion chamber 32 can be detected by the pressure sensor 120, and the voltage value of the battery 70 can be detected by providing a voltage measuring instrument.

In this way, according to the third embodiment, even in a case where the temperature of the machine rises due to the continuous use of the driving tool 10, the temperature rise is determined as the abnormality to stop the driving operation. Thus, the driving operation can be stabilized. In addition, whether or not the pressure in the combustion chamber 32, the supply pressure from the air source, or the like is abnormal is also determined. Thus, it is possible to prevent the breakage of the machine such as the combustion chamber 32 and the air injection valve 140 and to improve the durability. Further, according to this embodiment, it is possible to prevent the occurrence of the abnormal operation of the driving tool 10. Thus, the safety of the driving tool 10 can be improved further.

Herein, the chattering of the switch may be caused by the impact during the driving operation, so that the false detection of the switch may occur. With respect thereto, the false detection of the switch can be prevented by using a hard filter or a soft filter which determines whether the high or low signal of the switch continues for a predetermined time or more or by performing the control not to detect the switch until the predetermined time elapses after the output of the command of the turning-on of the trigger 62 or the ignition.

Incidentally, the technical scope of the invention is not limited to the above-described embodiment, and various changes may be made to the above-described embodiment within a range not deviating from the purpose of the invention. In addition, the processings which are described by using the flowcharts and the sequence diagrams in this specification may not necessarily be executed in the illustrated order. In addition, additional processing steps may be adopted, and some processing steps may be omitted.

In the above-described embodiment, as one example, the fuel is injected into the combustion chamber 32 when the contact switch 110 is turned on, and then the compressed air is injected into the combustion chamber 32 when the trigger switch 112 is turned on. However, the invention is not limited thereto. For example, when the contact arm 52 is pressed against the driving target member so that the contact switch 110 is turned on, the air injection valve 140 may be controlled to be opened to inject the compressed air into the combustion chamber 32, and then, when the trigger 62 is pulled so that the trigger switch 112 is turned on, the fuel injection valve 130 may be controlled to be opened to inject the fuel into the combustion chamber 32. According to such control, as well as the operation response is improved as described above, the wasteful use of the fuel can be prevented since the fuel is not injected even in a case where the contact arm 52 is repeatedly turned on.

What is claimed is:

1. A driving tool comprising:

a main body that has a combustion chamber configured to be filled with fuel and compressed air;

a trigger that is configured to operate an ignition device to combust a mixture of the fuel and the compressed air filled in the combustion chamber;

a contact member that is brought into contact with a driving target member to enable an operation of the trigger; and a control unit that is configured to start an injection of the fuel when the contact member is turned on, and wherein the control unit is configured to control injection of air to start the injection of air into the combustion chamber after the trigger is turned on and to complete the injection of the air after the trigger is turned on and by the time of igniting the mixture in the combustion chamber.

2. The driving tool according to claim 1, wherein the control unit is configured to operate the ignition device to ignite the mixture after a predetermined time elapses after the air starts to be supplied to the combustion chamber.

3. The driving tool according to claim 1, wherein the control unit is configured to operate the ignition device to ignite the mixture in a case where both of the contact member and the trigger are turned on.

4. The driving tool according to claim 1, further comprising:

a pressure measuring unit that is configured to measure pressure of the air supplied into the combustion chamber, wherein the control unit is configured to operate the ignition device to ignite the mixture in the combustion chamber when the pressure of the combustion chamber measured by the pressure measuring unit reaches a predetermined value.

5. The driving tool according to claim 1, wherein the control unit is configured to complete stirring of the mixture in the combustion chamber by the injection of the air after the trigger is turned on.

6. A driving tool comprising:

a main body that has a combustion chamber configured to be filled with fuel and compressed air;

a trigger that is configured to operate an ignition device to combust a mixture of the fuel and the compressed air filled in the combustion chamber;

a contact member that is brought into contact with a driving target member to enable an operation of the trigger; and a control unit that is configured to start an injection of the fuel when the contact member is turned on, and further wherein the control unit is configured to control injection of air to start the injection of air into the combustion chamber after the trigger is turned on, and wherein the control unit is further configured to control injection of air and ignition such that ignition occurs after completion of the injection of the air.

* * * * *